US011840371B2

(12) United States Patent
Carpenter

(10) Patent No.: US 11,840,371 B2
(45) Date of Patent: Dec. 12, 2023

(54) CONFIGURABLE PALLET

(71) Applicant: Pallet Technologies, LLC, Jacksonville, TX (US)

(72) Inventor: Byron R. Carpenter, Jacksonville, TX (US)

(73) Assignee: Pallet Technologies, LLC, Jacksonville, TX (US)

( * ) Notice: Subject to any disclaimer, the term of this patent is extended or adjusted under 35 U.S.C. 154(b) by 0 days.

(21) Appl. No.: 17/599,483

(22) PCT Filed: Mar. 27, 2020

(86) PCT No.: PCT/US2020/025552
§ 371 (c)(1),
(2) Date: Sep. 28, 2021

(87) PCT Pub. No.: WO2020/205666
PCT Pub. Date: Oct. 8, 2020

(65) Prior Publication Data

US 2022/0185537 A1 Jun. 16, 2022

Related U.S. Application Data

(60) Provisional application No. 62/826,867, filed on Mar. 29, 2019.

(51) Int. Cl.
*B65D 19/18* (2006.01)
*B65D 19/20* (2006.01)

(52) U.S. Cl.
CPC ..... *B65D 19/18* (2013.01); *B65D 19/20* (2013.01); *B65D 2519/00034* (2013.01);
(Continued)

(58) Field of Classification Search
CPC ..... B65D 19/18; B65D 19/20; B65D 2519/00034; B65D 2519/00044;
(Continued)

(56) References Cited

U.S. PATENT DOCUMENTS 2,928,638 A * 3/1960 Brooks ..... B65D 19/0016 29/897
3,470,832 A * 10/1969 Heffernan ..... B65D 19/0028 108/55.5

(Continued)

FOREIGN PATENT DOCUMENTS

CN 203143191 U 8/2013
DE 29606874 U1 7/1996

(Continued)

OTHER PUBLICATIONS

International Pat. Appl. No. PCT PCT/US2020/025552, International Search Report and Written Opinion dated Jun. 11, 2020, 10 pgs.

(Continued)

*Primary Examiner* — Jose V Chen
(74) *Attorney, Agent, or Firm* — Foley & Lardner LLP

(57) ABSTRACT

This disclosure provides a configurable pallet or load-bearing platform, such as a pallet, for supporting goods. The load-bearing platform may include one or more plastic bases having two or more protrusions connected by one or more bridge pieces. The two or more protrusions are spaced apart one or more distances. The load-bearing platform further includes a cardboard base having openings spaced apart an amount wherein the openings are configured to receive the two or more protrusions of the plastic base. A load distribution member may be included and configured to contact at least a portion of the plastic base. The load distribution member may support at least a portion of the goods and distributes at least a portion of the weight of the goods to at least a portion of the plastic base. The size of the cardboard base, as well as other components of the load-bearing platform, in certain implementations, may be customized on demand.

29 Claims, 11 Drawing Sheets

(52) U.S. Cl.
CPC ..... *B65D 2519/00044* (2013.01); *B65D 2519/00054* (2013.01); *B65D 2519/00069* (2013.01); *B65D 2519/00159* (2013.01); *B65D 2519/00194* (2013.01); *B65D 2519/00273* (2013.01); *B65D 2519/00293* (2013.01); *B65D 2519/00323* (2013.01); *B65D 2519/00338* (2013.01)

(58) Field of Classification Search
CPC ..... B65D 2519/00054; B65D 2519/00069; B65D 2519/00079; B65D 2519/00114; B65D 2519/00149; B65D 2519/00184
USPC ..... 108/51.3
See application file for complete search history.

(56) References Cited

U.S. PATENT DOCUMENTS 3,557,719 A * 1/1971 Gielas ..... B65D 19/20 108/56.3
3,709,160 A * 1/1973 Howard ..... B65D 19/0018 108/901
4,244,766 A * 1/1981 Yellen ..... B29C 66/112 156/291
4,378,743 A * 4/1983 McFarland ..... B65D 19/0097 108/55.3
5,213,050 A * 5/1993 Juvik-Woods ..... B65D 65/44 108/56.1
5,230,291 A * 7/1993 Juvik-Woods ..... B65D 19/0012 428/116
5,385,103 A * 1/1995 Juvik-Woods ..... B65D 19/0016 108/56.3
5,388,531 A * 2/1995 Crews ..... B65D 19/0012 108/56.3
5,535,668 A * 7/1996 Besaw ..... B65D 19/20 108/56.3
5,537,937 A * 7/1996 Juvik-Woods ..... B65D 19/0012 108/56.3
5,568,774 A * 10/1996 Hutchison ..... B65D 19/0073 108/56.1
5,603,258 A * 2/1997 Besaw ..... B65D 19/0012 156/233
5,672,412 A * 9/1997 Phares ..... B32B 3/266 428/184
5,704,487 A * 1/1998 Taravella ..... B65D 19/20 206/599
5,927,211 A * 7/1999 Giasi ..... B65D 19/0028 108/56.3
5,934,202 A * 8/1999 Lai ..... B65D 19/0012 108/57.33
5,996,509 A * 12/1999 Lai ..... B65D 19/0012 108/51.3
6,041,958 A * 3/2000 Tremelo ..... B65D 81/3813 220/636
7,886,672 B2 2/2011 Dickner et al.
8,256,621 B2 * 9/2012 Deiger ..... B65D 71/10 206/600
8,316,779 B2 * 11/2012 Gordon ..... B65D 19/20 108/51.11
10,486,853 B1 * 11/2019 Schopke ..... B65D 19/0071
2003/0000432 A1 * 1/2003 Crevillen Pastor ..... B65D 19/0028 108/51.3
2003/0079657 A1 * 5/2003 Preisler ..... B65D 19/0012 108/51.3
2006/0016373 A1 * 1/2006 Gordon ..... B65D 19/0016 108/51.3
2006/0065169 A1 * 3/2006 Chen ..... B65D 19/0026 108/51.3
2007/0227936 A1 * 10/2007 Youell, Jr. ..... B65D 19/20 206/600
2008/0083355 A1 * 4/2008 Meissen ..... B65D 19/0063 108/57.25
2009/0188411 A1 * 7/2009 Gibson ..... B65D 19/0022 108/51.3
2012/0260832 A1 * 10/2012 Linares ..... B65D 19/0095 108/57.17
2015/0274359 A1 * 10/2015 Linares ..... B65D 19/0004 108/53.1
2019/0061997 A1 * 2/2019 Behrens ..... B65D 77/061
2020/0095760 A1 * 3/2020 Fisk, III ..... E04B 1/34384
2020/0277102 A1 * 9/2020 Hartl ..... B65D 19/18
2021/0229861 A1 * 7/2021 Holmberg ..... B65D 19/0075
2022/0161967 A1 * 5/2022 Gibson ..... B65D 71/0096
2022/0289427 A1 * 9/2022 Coubray ..... B65D 19/0018

FOREIGN PATENT DOCUMENTS

FR 2087654 A5 12/1971
FR 2093053 A5 1/1972
FR 2261192 A1 9/1975
SE 524498 C2 8/2004
WO WO-83/03399 A1 10/1983
WO WO-8303399 A1 * 10/1983
WO WO-2005/105599 A1 11/2005
WO WO-2018/047740 A1 3/2018

OTHER PUBLICATIONS

Extended European Search Report on EP Pat. Appl. No. 20781823.8 dated Nov. 30, 2022, 10 pgs.

* cited by examiner

CONFIGURABLE PALLET

RELATED APPLICATIONS

This application is filed under 35 U.S.C. 371, and claims the benefit of and priority to PCT/US2020/025552, having a filing date of Mar. 27, 2020, entitled "CONFIGURABLE PALLET," which claims the benefit of and priority to U.S. Provisional Patent Application No. 62/826,867, having a filing date of Mar. 29, 2019, entitled "CONFIGURABLE PALLET, both of which are incorporated herein by reference in their entirety for all purposes.

TECHNICAL FIELD

This disclosure generally relates to a configurable pallet to support items, goods, and the like, and to provide a holding platform for the transportation of goods.

BACKGROUND

Conventional pallets are heavy, flat transport structures for supporting goods in a secure manner when the structures are lifted by a vehicle, such as a forklift. Other lifting equipment may be used, including a pallet jack, a front loader, a jacking device, or a crane. Goods placed on a pallet may be secured with strapping, stretch wrap, or shrink wrap. Such pallets may be made, generally, of wood or plastic, are expensive to purchase, and often are not durable, resulting in high costs for repair or replacement.

Very often, pallets are made according to a standard size, depending on a particular industry. Such standardized sizes require a particular shipping configuration to fully load a pallet or the transportation of the shipment may not be efficient. Standardized sizes may not be readily available or may not be available for undersized or oversized goods, or custom orders. Further, the storage of empty pallets is cumbersome and costly. Often, empty pallets have to be stored or shipped back to other locations for future storage and use, all of which is expensive and undesirable. Pallets may not be recyclable at all or may not be readily recyclable.

SUMMARY

This summary is provided to introduce various implementations that are further described below in the detailed description. This summary is neither intended to identify key or essential features of the claimed subject matter, nor is it intended to be used as an aid in limiting the scope of the claimed subject matter. At a high level, this disclosure presents one implementation of a configurable pallet system that enables efficient production of pallets on demand according to specified dimensions regardless of any pallet standards. The disclosed configurable pallet, its system, and the methods of manufacturing thereof allow a user to configure a load-bearing platform to carry virtually any specific ordered packaging dimensions of goods. Before assembly, the components of the configurable pallet can be stored in a compact, efficient manner, saving, in certain implementations and situations, thirty times or more the space required to store traditional pallets. Such space saving capabilities enable efficient storage and transportation. Further, the weight of the configurable pallet is substantially less than traditional pallets, saving energy and costs during transportation, whether by air or ground transportation. Various other advantages may be provided in certain implementations of the configurable pallet, system, and methods.

In a first general aspect or possible implementation, a configurable pallet, which may be referred to as a load-bearing platform, for supporting goods may include a plastic base having two or more protrusions connected by one or more bridge pieces and a cardboard base having openings spaced apart a distance. The two or more protrusions are spaced apart the distance, or some distance such that the protrusions may be placed in or through the openings. The openings are configured to receive the two or more protrusions of the plastic base. The load-bearing platform may further include a load distribution member configured to contact at least a portion of the plastic base. The load distribution member supports at least a portion of the goods and distributes at least a portion of the weight of the goods to at least a portion of the plastic base.

It should be noted that the term "cardboard" as used herein may refer to any material that may be provided as a sheet or roll and have certain mechanical properties as those of a wood fiber or paper-based materials or sheets. In certain embodiments or implementations, the cardboard may be a poster board, a paperboard, a corrugated fiberboard, a non-woven sheet or material, and the like. The cardboard may be recyclable. In some embodiments, the cardboard may be a heavy-duty paper-based board made of recyclable materials or biomass materials that can be cut by a knife, laser, and/or jet, and may also include other paper forming methods, such as stamping, rolling, among others. In other embodiments, the cardboard may be plastic, polymer fiber, cellulose, and/or cellulose fiber based, such as a sheet of plastic, epoxy, glass fiber, composite fiber, cellulose fiber, nonwoven fiber, or a mixture thereof, which may also be cut and formed using methods similar to or equivalent to paper-based cardboards. Computer numerical controlled machines may be used to cut the cardboard, regardless of specific material composition, into desired shapes for folding and/or bending into the configurable pallets disclosed herein.

In a specific aspect, the load-bearing platform may further include a cardboard top, piece, or sheet that serves as at least a portion of the load distribution member and connects or contacts at least a portion of the bridge piece, and, in certain implementations, also the cardboard base. The cardboard top supports at least a portion of the goods placed thereon.

In another specific aspect, the cardboard base may further include at least one or more peripheral walls in a vertical position or upward angled position. In some embodiments, the cardboard base includes four peripheral walls. The peripheral walls prevent relative side movements between the loaded goods and the load-bearing platform.

In yet another specific embodiment, the cardboard base may be positioned in a flat horizontal position during production, storage, and transportation. The at least one peripheral wall is folded from the flat horizontal position to the vertical position. In some embodiments, the at least one folded peripheral wall abuts against or may be adjacent to the plastic base when the plastic base is fully inserted into the cardboard base.

In another example implementation, the plastic base may include a side wall extending substantially orthogonally (or some other angle) upward from a side edge of the bridge piece. The side wall of the base may be enclosed into or adjacent the at least one folded peripheral wall of the cardboard base in one embodiment, and not enclosed in another.

In another specific aspect, the bridge piece is affixed onto the cardboard base using an adhesive, or some mechanical coupling or binding.

In yet another specific aspect, the plastic base is shaped such that the protrusions of the plastic base can stack within another identical or similar plastic base.

In a specific aspect, the plastic base includes three protrusions and two bridge pieces. In some embodiments, the load-bearing platform further includes two additional plastic bases. The three plastic bases may include three protrusions so as to provide nine protrusions in total. The cardboard base may include at least nine openings configured to receive the nine protrusions. Of course, any desired number of protrusions may be provided in a plastic base and corresponding openings in the cardboard base, such as 2×2, 3×3, 4×4, 5×5, 2×3, 2×4, etc., or any desired or needed number of protrusions. These arrangements may be symmetrical or asymmetrical, as desired. Different types or configurations of plastic bases may be used in a configurable pallet or load-bearing platform as provided and taught herein.

In another example aspect, the load-bearing platform further includes a number of plastic bases with two or more protrusions. The protrusions are legs for providing a space between the cardboard base and a ground surface. The space may allow a tool or member, such as a forklift to insert a fork underneath the cardboard base. In some example embodiments, the protrusions may include a textured surface in contact with the ground surface. The textured surface may either increase friction with the ground surface by increasing contact pressures or decrease friction with the ground surface, which may allow a loaded configurable pallet to be more easily maneuvered on a surface, such as by sliding on the bottom textured surface of the protrusions of the plastic base or bases.

In yet another specific aspect, the plastic bases may be stacked and stored together by inserting the protrusions of one of the plastic bases into the open or hollowed back sides of the corresponding protrusions of another of the plastic bases. In certain implementations, this may be similar to stacking drinking cups within one another, and may provide convenient and efficient storage.

In one specific aspect, the cardboard base includes a first set of cut lines or folds for removing pieces to create the openings, and a second set of cut lines or folding lines for folding up the at least one peripheral wall.

In yet another aspect, the disclosure presents a method for making a configurable pallet for supporting goods. The method includes providing or producing a plastic base with a first dimension distance between at least two protrusions. The plastic base has two or more protrusions spaced apart by the first dimension and connected by a bridge piece. A cardboard base is provided or produced with multiple openings therein. The openings correspond to the two or more protrusions of the plastic base spaced to receive the protrusions of the plastic base, such as, in one implementation, spaced apart by the first dimension. The two or more protrusions of the plastic base may be inserted into the openings of the cardboard base to form the configurable pallet.

The method may further include producing a cardboard top sized to cover all or a portion of the cardboard base and at least a portion of the bridge piece to support at least a portion of the goods. This may be referred to as a load distribution member. Just as with the cardboard base, the load distribution member may be made of cellulose or plastic.

In another specific aspect, the method may further include applying adhesives between a bottom surface of the bridge piece of the plastic base and the cardboard base. In other implementations, a coupling, such as a mechanical coupling or a friction fit may be provided between the bridge piece of the plastic base and the cardboard base.

In yet another aspect, producing a plastic base may include producing a plurality of plastic bases. In some embodiments, producing a cardboard base includes producing a plurality of openings corresponding to the two or more protrusions of the plurality of produced plastic bases and wherein inserting the two or more protrusions of the plastic base includes the two or more protrusions of the plurality of plastic tops into the plurality of openings of the cardboard.

In one implementation, producing the cardboard base further includes stamping, laser cutting, or machining the cardboard base to make the plurality of openings. In some embodiments, producing the cardboard base further includes receiving a length dimension and a width dimension defining a surface area of the cardboard base or area to be covered with goods.

In another specific aspect, producing the cardboard base further includes producing a side tab foldable into a peripheral wall abutting against the plastic base when the protrusions of the plastic base are fully inserted into the cardboard base. In some embodiments, producing the plastic base with the first dimension further includes producing a side wall extending substantially orthogonally upward or at some other desired angle from a side edge of the bridge piece. The side wall of the plastic waste may extend continuously or contain gaps or openings, and may be enclosed into the folded peripheral wall of the cardboard base or may be left uncovered.

In another aspect, a configurable pallet may include a cardboard base having an array of openings and two or more plastic bases. The array of openings may include an opening spacing dimension and a coverage area, both specified by a user. Two or more of the plastic bases having two or more protrusions connected by a bridge piece and spaced apart at some position by the opening spacing dimension. The two or more protrusions may be inserted into the array of openings in the cardboard (and may allow the plastic bases to be stackable within one another in certain implementations). The configurable pallet further includes a cardboard member or load distribution member positioned at least partially over one or more bridge pieces of the two or more plastic bases and a part of the cardboard base, the cardboard top at least partially supporting goods placed thereon.

In a specific aspect, the configurable pallet may further include a sleeve configured to be supported by the plastic bases and the cardboard base, and to surround the goods or items placed on the configurable pallet.

In another specific aspect, the configurable pallet may further include a cardboard lid configured to fit over a top opening in the sleeve. For example, the cardboard lid may be a folded piece having similar side walls as the cardboard base, except that the cardboard lid does not include openings for receiving plastic bases.

In yet another specific aspect, the sleeve may be provided as two pieces of angled cardboard or other desired material. For example, each of the two angled cardboard pieces may be configured as an "L" shaped insert covering two sides of the loaded goods, so as to completely surround all four sides of the loaded goods or cargo. This allows one person to easily remove the sleeve without the need for a ladder or other tools. This may be especially convenient in a retail display environment where one worker at a retail store may simply remove the two pieces of angled cardboard to display merchandise for sale.

In another aspect, a method for making a configurable pallet includes receiving a plastic base having two or more protrusions; the two or more protrusions spaced apart by a first dimension and connected by a bridge piece. A second dimension may be received defining a distance between two pieces of the plastic base. A cardboard base is produced with multiple openings using the first dimension and the second dimension. Each of the multiple openings fitting one of the two or more protrusions. The two or more protrusions of two or more pieces of the plastic base are inserted into the multiple openings to form the configurable pallet.

BRIEF DESCRIPTION OF THE DRAWINGS

For a more complete understanding of various embodiments of the present invention and the advantages thereof, reference is now made to the following brief description, taken in connection with the accompanying drawings (which may not be necessarily drawn to scale), appendices, and detailed description, wherein like reference numerals represent like parts, and in which.

DETAILED DESCRIPTION

Embodiments disclosed herein present a configurable pallet, which may also be referred to as a load-bearing platform, that can be customized to desired specified sizes. The configurable pallet may include three components to be made according to specific dimensions. As a result, the configurable pallet may be ordered to fit virtually any amount and any size products for transportation, including various shipping arrangements of such products or goods. This may decrease or remove a need to store large quantities of standardized pallets that may not provide a platform size to fit a specific shipment. Two or more configurable pallets of a customized size may be stacked together. Unlike conventional pallets, which are heavy and usually provide a flat surface for receiving generic goods, the configurable pallets are light weight, normally recyclable, may contain stackable components, and may include peripheral side walls for receiving specifically packaged goods to avoid relative side movements. Other benefits may be appreciated in view of the following detailed description.

In the following detailed description and the attached drawings and appendices, numerous specific details are set forth to provide a thorough understanding of the present disclosure. However, those skilled in the art will appreciate that the present disclosure may be practiced, in some instances, without such specific features or details. In other instances, well-known elements have been illustrated in schematic or block diagram form in order not to obscure the present disclosure in unnecessary detail. Additionally, for the most part, specific details, and the like, have been omitted inasmuch as such details are not considered necessary to obtain a complete understanding of the present disclosure, and are considered to be within the understanding of persons of ordinary skill in the relevant art.

Figure 1:
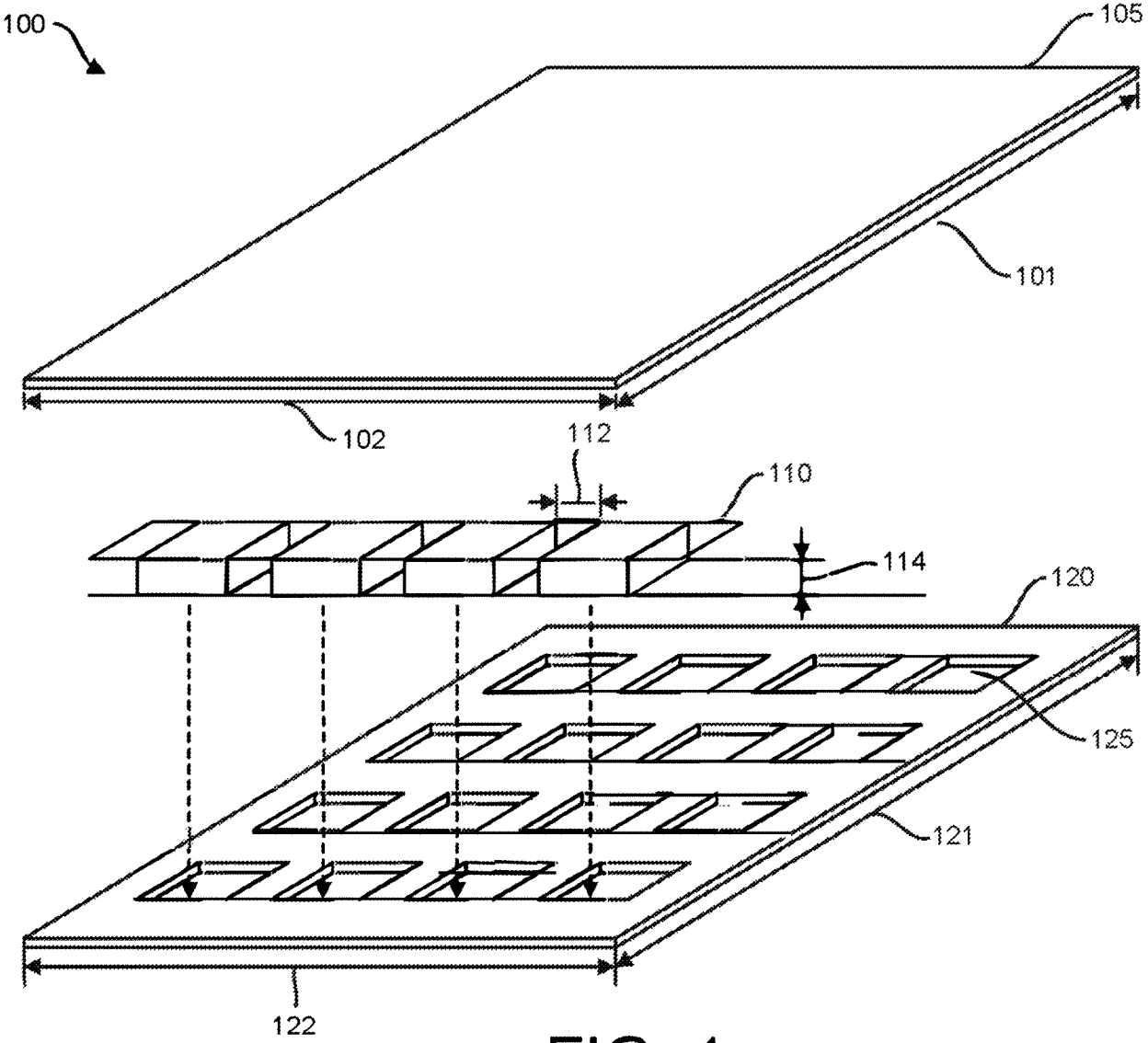
FIG. 1 illustrates an exploded perspective view of an example configurable pallet or load-bearing platform illustrating, among other things, an arrangement of openings of a cardboard base and a load distribution member.
Figure 2:
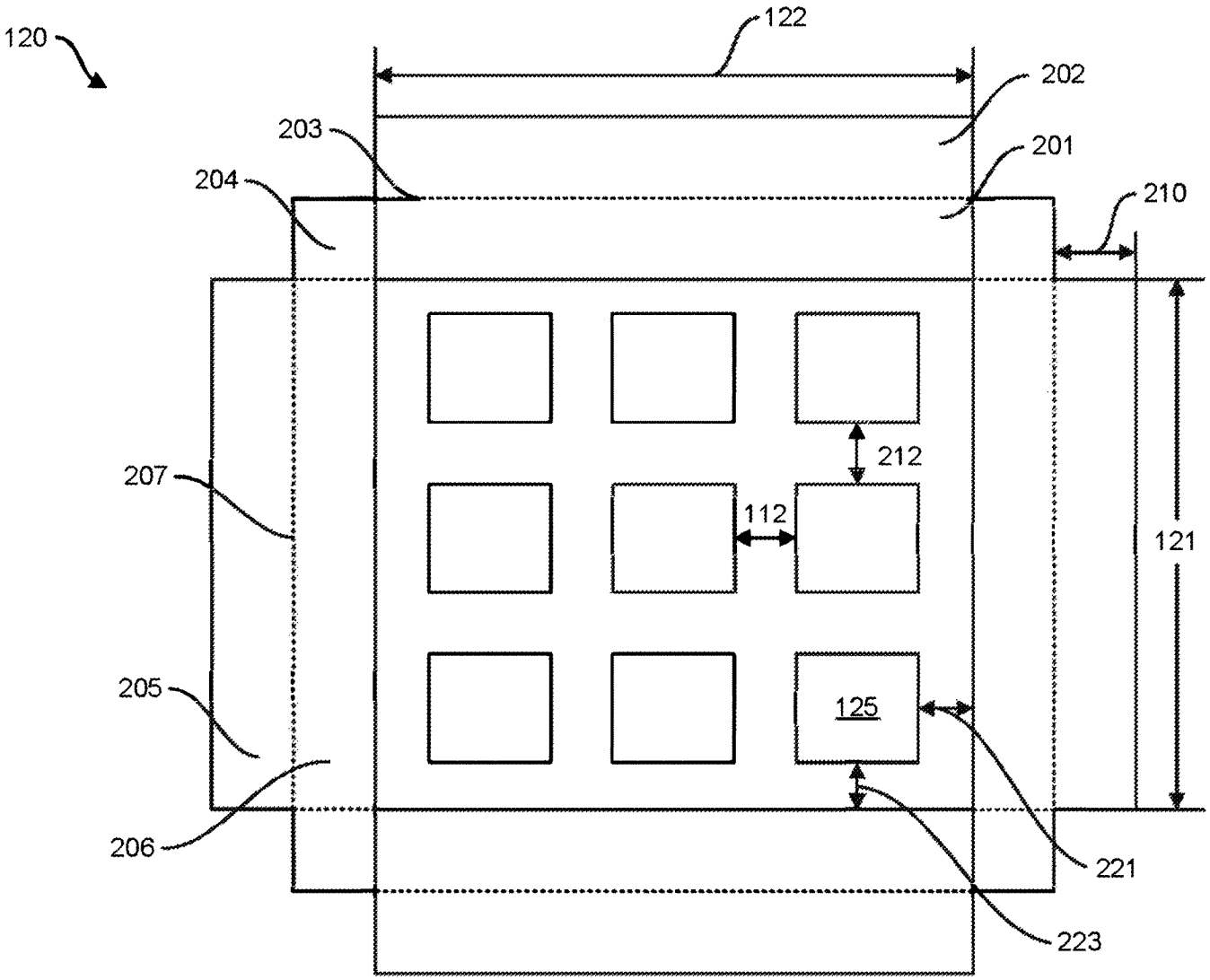
FIG. 2 illustrates a flattened or top view of the bottom piece, which may be a cardboard base in certain embodiments, of the example configurable pallet shown in FIG. 0.1.
Figure 3B:
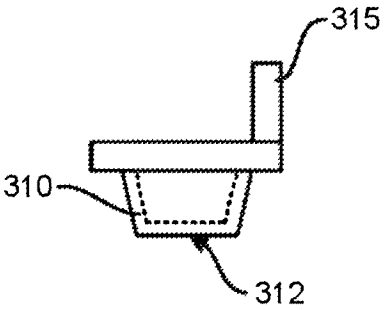
FIGS. 3A, 3B, and 3C respectively illustrate a front view, a side view, and a top view of an example plastic base that may be used in the example configurable pallet shown in FIG. 1.
Figure 3A:
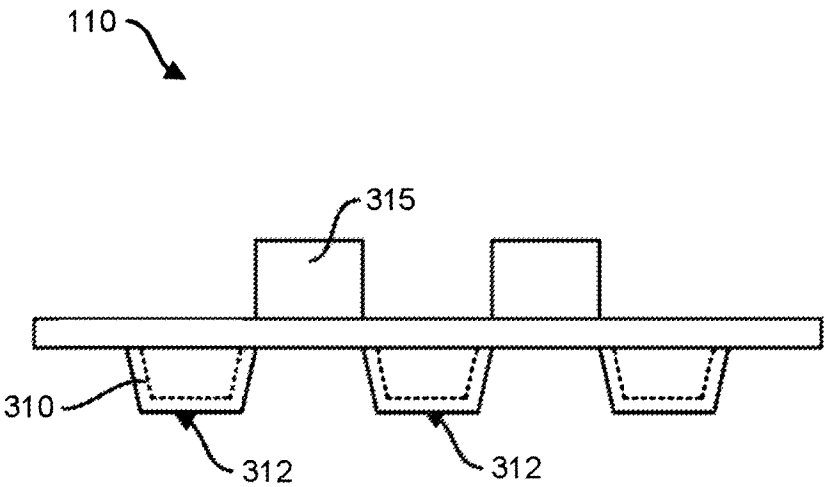
Figure 3C:
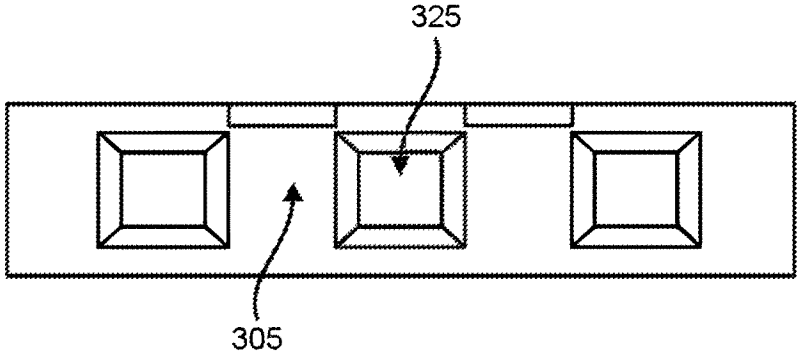

Turning generally to FIGS. 1, 2, and 3A, 3B, and 3C, FIG. 1 illustrates an exploded perspective view of an example configurable pallet 100 illustrating, among other items, an arrangement of openings 125 of a cardboard base. FIG. 2 illustrates a flattened or top view of the bottom piece of the example configurable pallet 100 shown in FIG. 1. FIGS. 3A, 3B, and 3C respectively illustrate a front view, a side view, and a top view of an example plastic base that may be used in the example configurable pallet 100 shown in FIG. 1.

The configurable pallet 100 may be a customizeable load-bearing platform for supporting goods or objects arranged in various configurations as desired. The configurable pallet 100 may include a cardboard base 120, one or more plastic bases 110 (which may be implemented or shaped as plastic bases 110 of FIGS. 3A, 3B, and 3C), and a load distribution member 105 that may be implemented as a cardboard top or sheet. The plastic base 110 has two or more protrusions 310 connected by one or more bridge pieces 305 (see FIGS. 3A-3C). The two or more protrusions 310 spaced apart a distance 112. In some embodiments, the distance 112 is a standard value. In other embodiments, the distance 112 may be customized or vary within one plastic base with multiple protrusions.

The cardboard base 120 has openings 125 spaced apart the distance 112 in one direction and, in other embodiments, may be spaced a different distance in an orthogonal direction between the openings 125, such as distance 212. The openings 125 are configured to receive the two or more protrusions 310 of the plastic base 110. The load distribution member 105 is configured to contact at least a portion of the plastic base 110 for distributing the loads from the load distribution member 105 to the plastic bases 110. The load distribution member 105 may support at least a portion of the goods placed thereon and distributes at least a portion of the weight of the goods to one or more of the plastic base 110. In an embodiment, the cardboard base 120 has nine openings in an array of three by three. This allows for inserting three plastic bases 110 there through. Each of the three plastic bases 110 includes three protrusions in this example. The protrusions may have a clearance height 114 sufficient to allow equipment, such as a forklift, to handle, lift, or move a loaded load-bearing platform 100.

In some embodiments, the configurable pallet 100 (which also may be referred to as the load-bearing platform 100) uses a cardboard top 105 as the load distribution member. For example, the cardboard top 105 may be made of a same or similar dimension as the cardboard base, or may be provided as strips or pieces covering only a portion of the bridge piece 305 of the plastic base 110 and/or the cardboard base 120. The cardboard top 105 may sandwich the bridge piece 305 with the cardboard base 120. The cardboard top 105 is used to support at least a portion of the goods placed thereon and distribute the weight of the goods to one or more of the plastic bases 110 and onto the cardboard base 120.

In FIG. 1, the cardboard base 120 includes a bottom configurable length 121 and a bottom configurable width 122. These two dimensions may be customized based on specific packaging sizes on demand or as desired. Similarly, the number and locations of openings 125 may also be configured, such as to allow a forklift to handle the loaded platform at a corresponding center of gravity toward a particular location, if not at the center. The load distribution member 105 may have a top configurable length 101 and a top configurable width 102 being the same as or different from the respective bottom configurable length 121 and the bottom configurable width 122.

Figure 4:
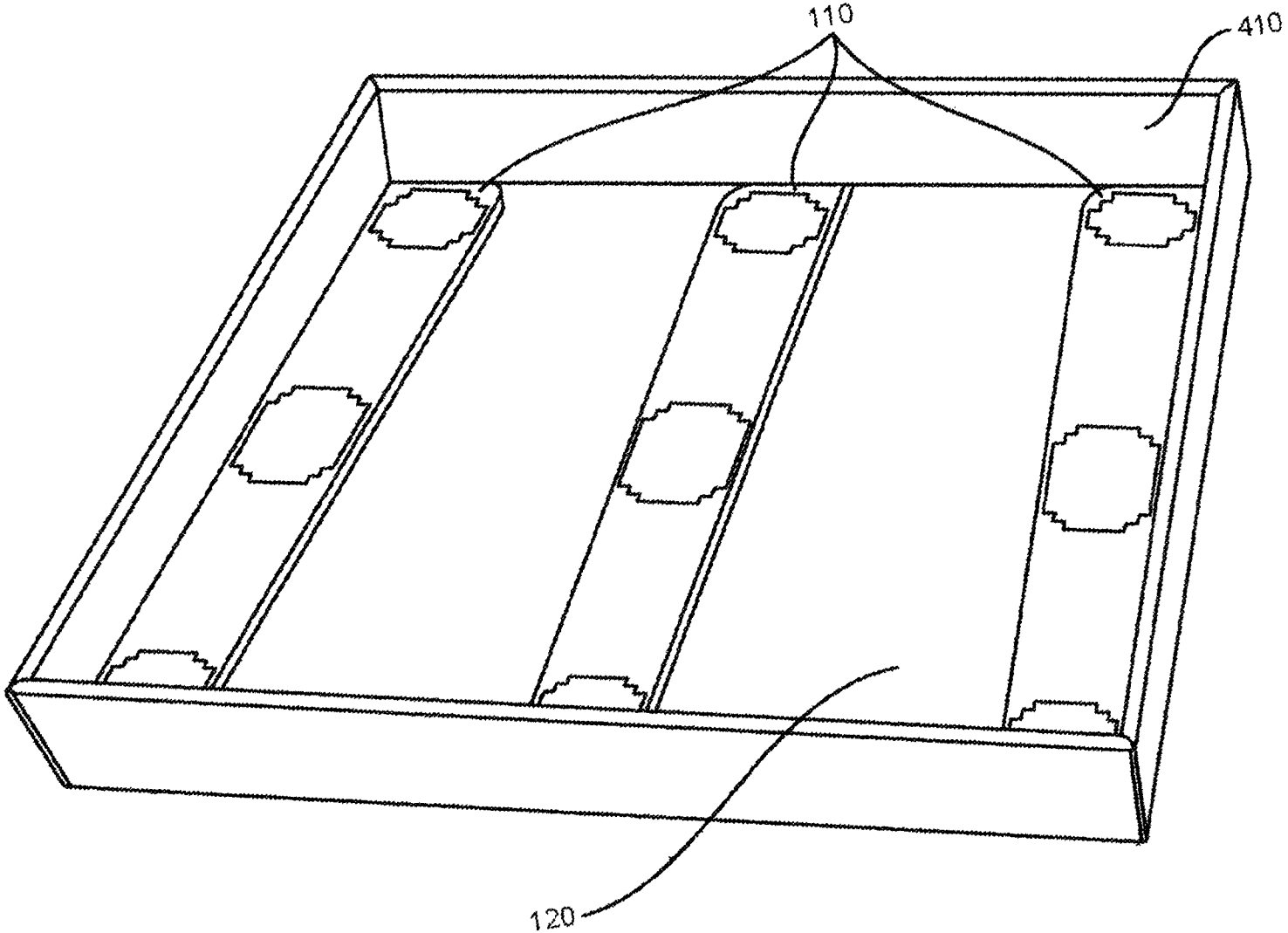
FIG. 4 illustrates a perspective view of a first embodiment of an assembled configurable pallet.
Figure 5:
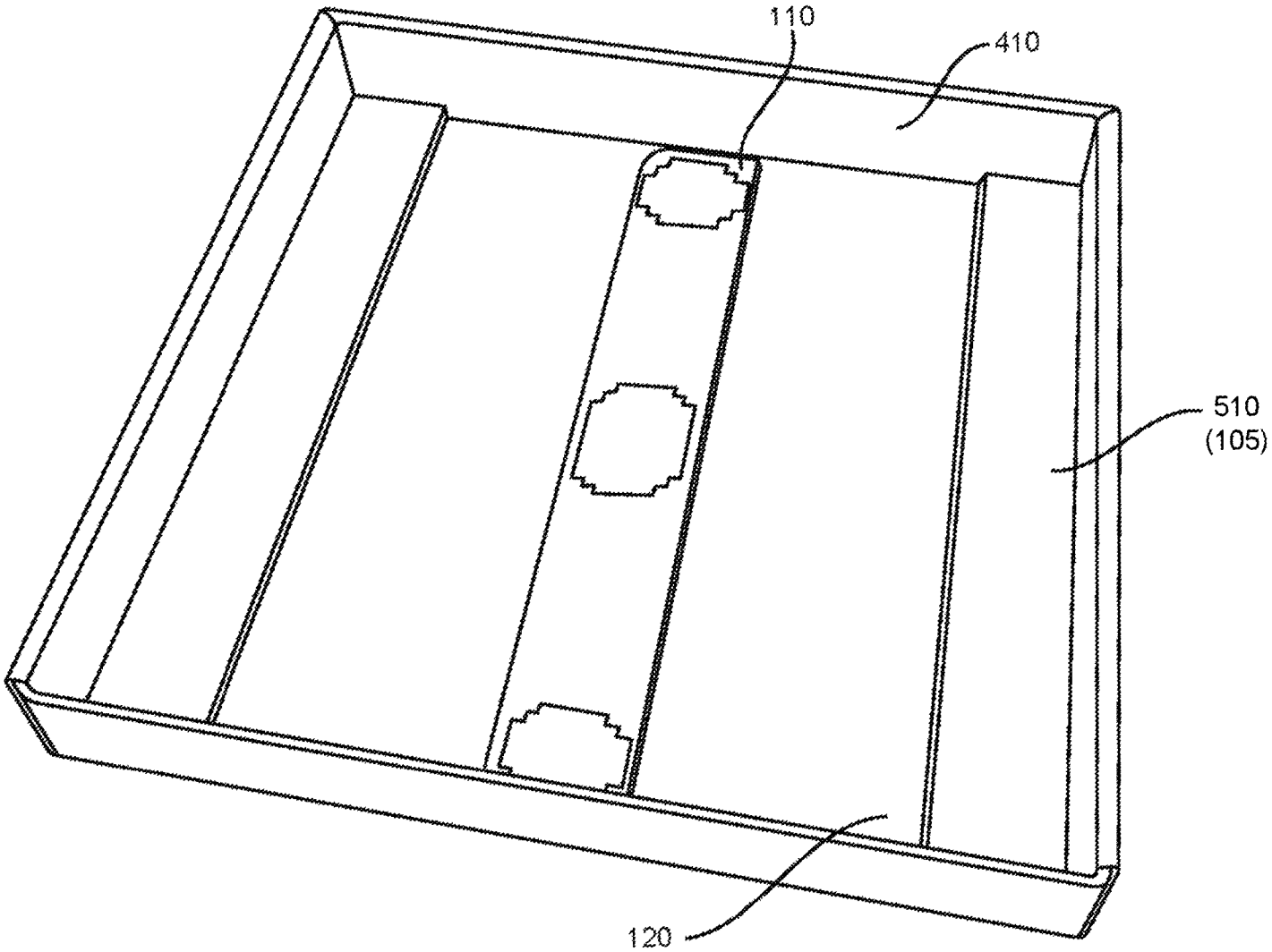
FIG. 5 illustrates a perspective view of another embodiment of an assembled configurable pallet.

As shown in FIGS. 2, 4, and 5, the cardboard base 120 may further include at least one peripheral wall 410 folded in a vertical position to prevent or minimize relative lateral movements between the configurable pallet 100 and the goods placed thereon. Turning now to FIG. 2, the cardboard base 120 further includes, in this implementation, four peripheral walls 410 foldable from pre-cut geometries. For example, at least one peripheral wall 410 may be folded from a flat horizontal position to the vertical position, such that the cardboard base 120 may be cut and creased using a numerically controlled machine. When folded, the at least one folded peripheral wall 410 may abut against or be positioned adjacent the plastic base 110 when the plastic base 110 is fully inserted into the cardboard_base 120, as shown in FIGS. 4 and 5.

Turning now to FIG. 2, an example pre-cut pattern for the cardboard base 120 is shown. In the illustrated example, a rectangular profile is used. However, the configurable pallet 100 may be cut into different shapes under the same working principle that may or may not be square or symmetrical. In FIG. 2, each side of the rectangle may include a peripheral wall outer side 201 (and 206) and a peripheral wall inner side 202 (and 205) when folded, divided by a dashed (or serrated) cutline or crease 203 (and 207) facilitating folding. Tabs 204 may be pre-cut to reinforce the connection between the folded walls. The configurable pallet 100 may allow user specific margins 221 and 223 to be provided in order to have goods fit tightly or as desired into the folded peripheral walls 410 (FIG. 4). In some embodiments, the cardboard base 120 includes a first set of cut lines (e.g., defining the openings 125) for removing pieces to create the openings 125 and a second set of cut lines (e.g., the creases 203 and 207) for folding up the peripheral walls 410.

Depending on the required load distribution, a spacing distance 212 and 112 may also be defined to include additional plastic bases 110. For example, although three plastic bases 110 (each with three protrusions) correspond to the nine openings for the example shown in FIG. 2, the distance 212 and/or 112 may be reduced (or adjusted as desired) to allow for four plastic bases 110 for providing a more even loads distribution if the loaded goods have a greater weight. Although the distance 112 and the distance 212 are shown as generally the same, in other embodiments, these spacing distances between openings 125 may be different as desired.

In some embodiments, as shown in FIG. 5, the inner sides 202 and 205 of the peripheral walls 410 may include or serve as an extended portion 510 to partially overlap with the plastic base 110 in the place of (or in addition to) the cardboard top 105. That is, the extended portion 510 may serve as a load distribution member, such as the load distribution member or the cardboard top 105, and thus a full coverage cardboard top piece may be eliminated or reduced, if desired.

Turning now to FIGS. 3A, 3B, and 3C, details of the plastic base 110 are illustrated. The plastic base 110, as shown, may include two or more protrusions 310 and a continuous or discrete (or spaced) side wall 315. In other embodiments, the side wall 315 is not provided. One or more of the protrusions 310 may include a textured bottom surface 312. The plastic base 110 may be shaped such that the plastic base 110 can overlap and stack upon another plastic base 110, for example, when the protrusions 310 are hollow and can be stacked like foam or plastic cups. That is, the plastic base 110 and additional plastic bases 110 can be stacked together by inserting the protrusions 310 of one of the plastic bases 110 into the hollow openings 325 of the protrusions 310 of another. This provides for efficient storage of such components.

The plastic base 110 includes a separated (illustrated) or continuous side wall 315 extending substantially orthogonally upward from a side edge of the bridge piece 305. In other embodiments, the side wall 315 may extend upwardly at any desired angle. The side wall 315 may be enclosed into the folded peripheral walls 410 of the cardboard base 120 to provide increased bending stiffness and material reinforcement. For example, the plastic base 110 may be immune to water or moisture damage and thus more reliable than the folded side walls 410 of the cardboard base 120.

In some embodiments, the bridge piece 305 may be affixed onto the cardboard base 120 using an adhesive (not shown). The adhesive may be a resin, a thermoplastic, or the like or other desired adhesive. The adhesive may further prevent local delamination, in addition to the folded peripheral walls 410 keeping the cardboard base 120 mounted with one or more of the plastic bases 110. In other embodiments the bridge piece 305 may be affixed to the cardboard base 120 using any available or desired mechanical coupling or linkage, including, for example, friction fit or threaded couplings.

In the illustrated embodiment, the plastic base 110 includes three protrusions 310 and two bridge pieces 305. However, in other embodiments, a different number of protrusions may be used or configured. The bridge pieces 305 are shown to be of the same length, however, in different configurations, they may be configured as different lengths.

Turning now to FIGS. 4 and 5, the configurable pallet 100 are shown to include three plastic bases 110. Each of the three plastic bases 110 includes three protrusions 310 that extend below (not shown) the cardboard base 120 so as to provide nine protrusions 310 in total. The cardboard base 120 has nine openings 125 for receiving the nine protrusions 310. The nine protrusions 310 serve as legs (not shown) for providing a space between the cardboard base 120 and a ground surface. The space allows a member or tool, such as a forklift to insert a fork underneath the cardboard base 120. Each of the nine protrusions 310 may include a textured bottom surface 312 that will be in contact with the ground surface when in use.

In some embodiments, the configurable pallet 100 includes a cardboard base 120 having an array of openings 125. The array may include an opening spacing dimension 212, 112, or as desired by a user, and a coverage area specified by a user. The configurable pallet 100 may further include two or more plastic bases 110, which are normally separate but could include some linkages, such as plastic linkages if formed from the same mold. Each of the two or more plastic bases 110 may have two or more protrusions 310 connected by a bridge piece 305 and spaced apart by a user-defined opening spacing dimension 212, 112, or as desired or as needed. The two or more protrusions 310 may be sized similarly or differently, and are to be inserted into the array of openings 125. A cardboard top 105, or extended portion 510, may sandwich the bridge piece 305 with the cardboard base 120 and support goods placed thereon.

Figure 6A:
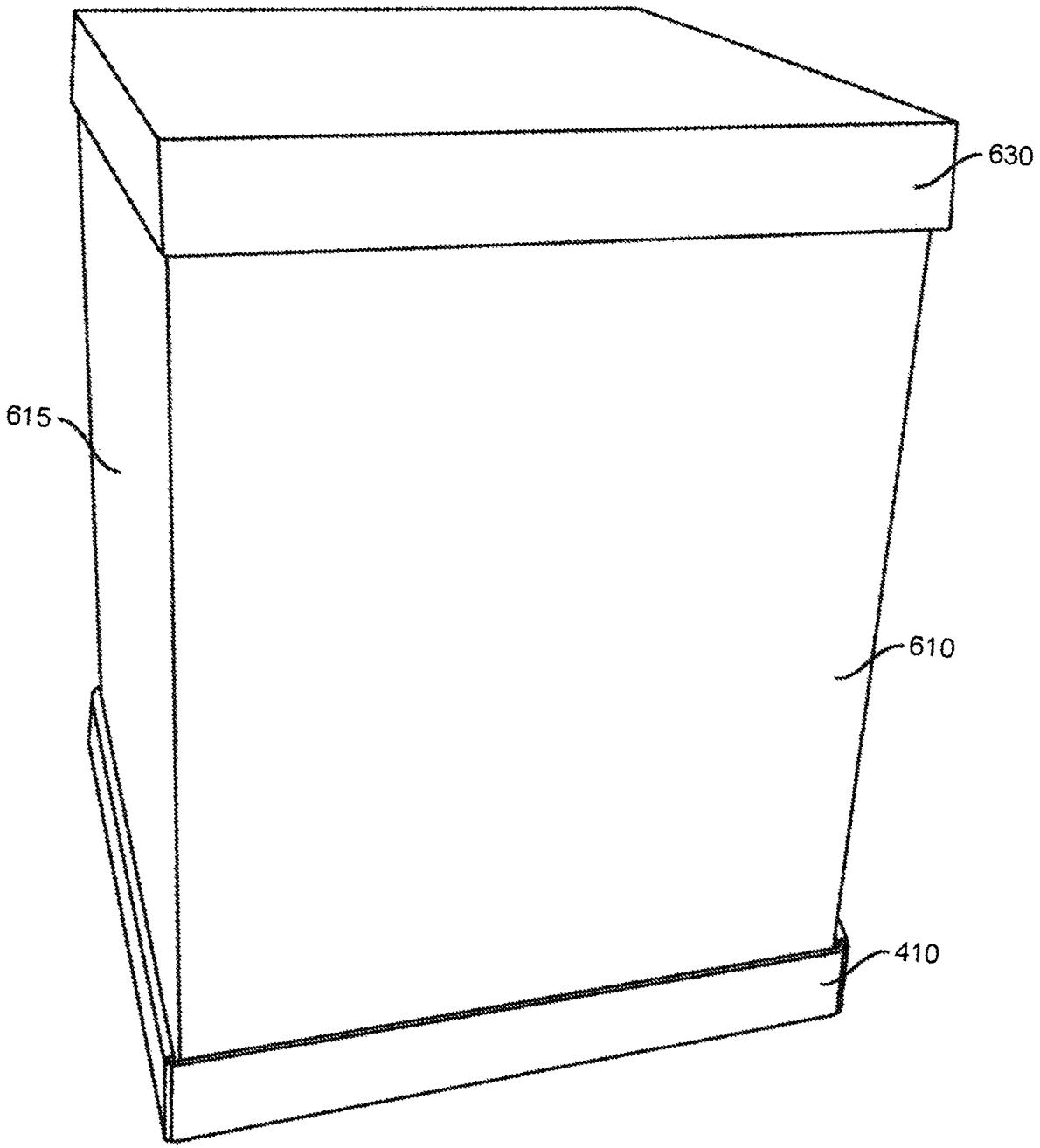
FIGS. 6A, 6B, and 6C illustrate perspective views of variations of other embodiments of an assembled configurable pallet with protective side sleeves and a lid.
Figure 6B:
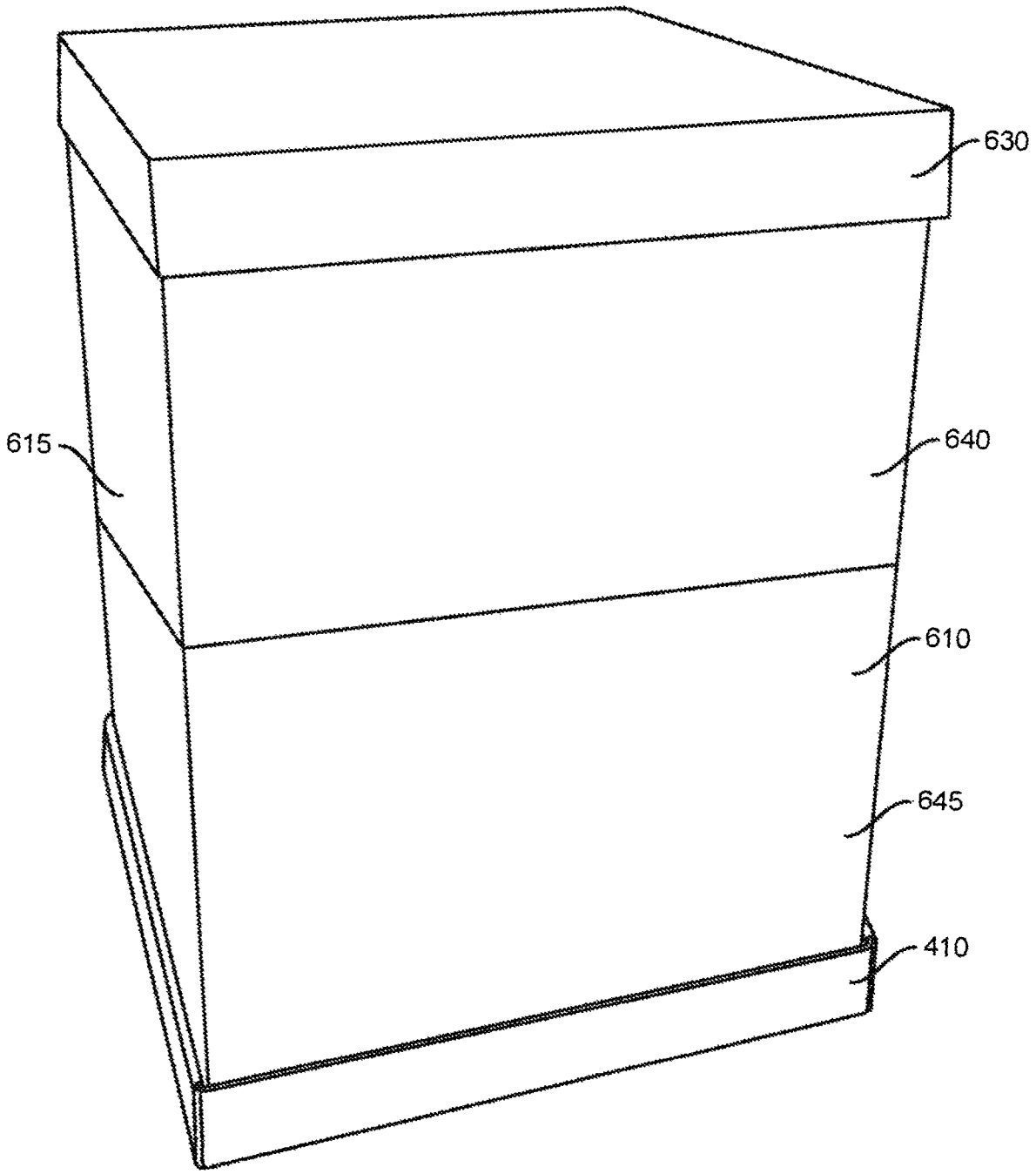
Figure 6C:
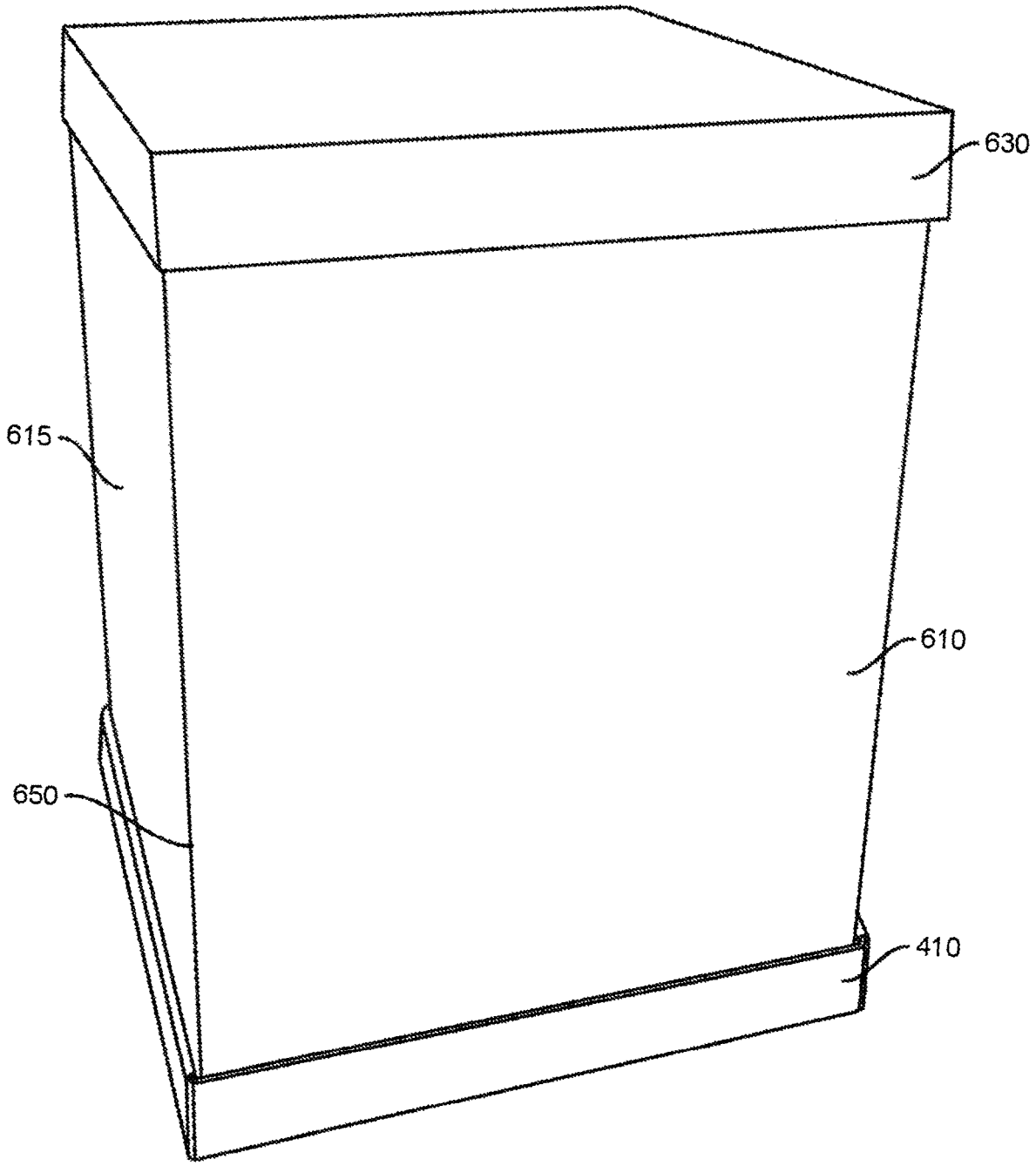

Turning now to FIGS. 6A, 6B, and 6C, these figures illustrate perspective views of variations of an embodiment of an assembled configurable pallet 100 with protective side sleeve(s) 610 (and 615 in other embodiments) and a lid 630. In one embodiment, the side sleeve 610 is one piece that surrounds the cargo or goods stored on the configurable pallet 100. In FIG. 6A, the sleeve 610 is configured to be supported at least partially, in one implementation, by the plastic bases 110 and the cardboard base 120, and to surround the goods placed on the configurable pallet 100. In some embodiments, the cardboard lid 630 is included and configured to fit over a top opening in the sleeves 610 and 615.

In FIG. 6B, the sleeves 610 and 615 may be provided as an upper portion sleeve 640 and a lower portion sleeve 645 for reducing the storage size, and for ease of installation or positioning of the sleeves. Although the upper portion sleeve 640 and the lower portion sleeve 645 are illustrated, three or more of the sleeve portions may be provided to cover the sides of the loaded cargo. This may reduce the storage size for each sleeve portion and increase the versatility when multiple sleeves are stacked together to cover a desired height. For example, if each sleeve covers a height of one foot, it would be convenient to stack five sleeves to cover five feet. Further, it is much easier for one person to remove smaller sleeves than one large sleeve, when unpacking the configurable pallet with goods stored thereon.

In FIG. 6C, the sleeves 610 and 615 may be provided as two pieces of angled cardboard, for example, having an "L" shaped cross-section and separated at the edge 650. The junction between sleeve 610 and sleeve 615 at edge 650 is not shown in detail in FIG. 6C. In some embodiments, this junction may include an inner lip, ledge, fold, overlap, or attachment portion for preventing contaminants from entering through the gap at the junction at the edge 650. The "L" shaped configuration enables each piece of the sleeves 610 and 615 to be stored flat for saving space, and to be easily and readily placed in position by one person and easily removed without the need for a ladder if the sleeve were one piece. In one implementation, the goods or cargo stored on the configurable pallet 100 may include a point of sale or display such that a worker at a retailer may simply receive the item as shown in FIG. 6C at the retail store, place the item at the desired sales location in the retail store, remove the lid 630, and conveniently remove the sleeves 610 and 615 so that consumers may view and purchase the goods already positioned on the point of sale display. This may provide significant savings and convenience to retailers, while allowing the light-weight, configurable pallet to be easily moved and positioned as desired in a retail store. In certain embodiments, the bottom surface 312 of the protrusions 310 (see FIG. 3B) may include a texture that serves as "sliders" to reduce sliding friction to allow one or a few personnel to push the configurable pallet across a suitable floor to a desired location while still loaded with goods or products.

Figure 7:
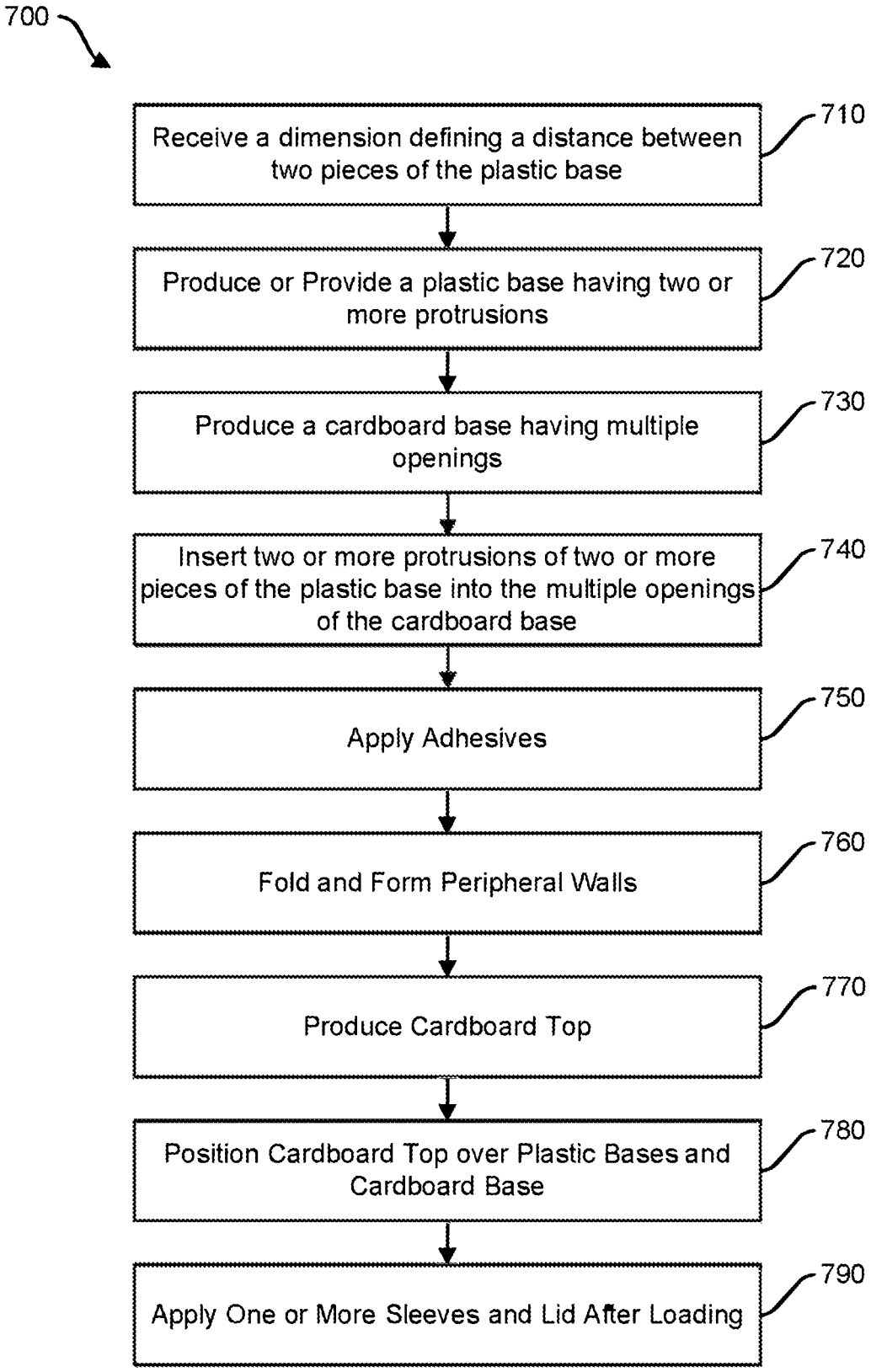
FIG. 7 is a flow chart illustrating on implementation of a method for making an example configurable pallet.
Figure 8:
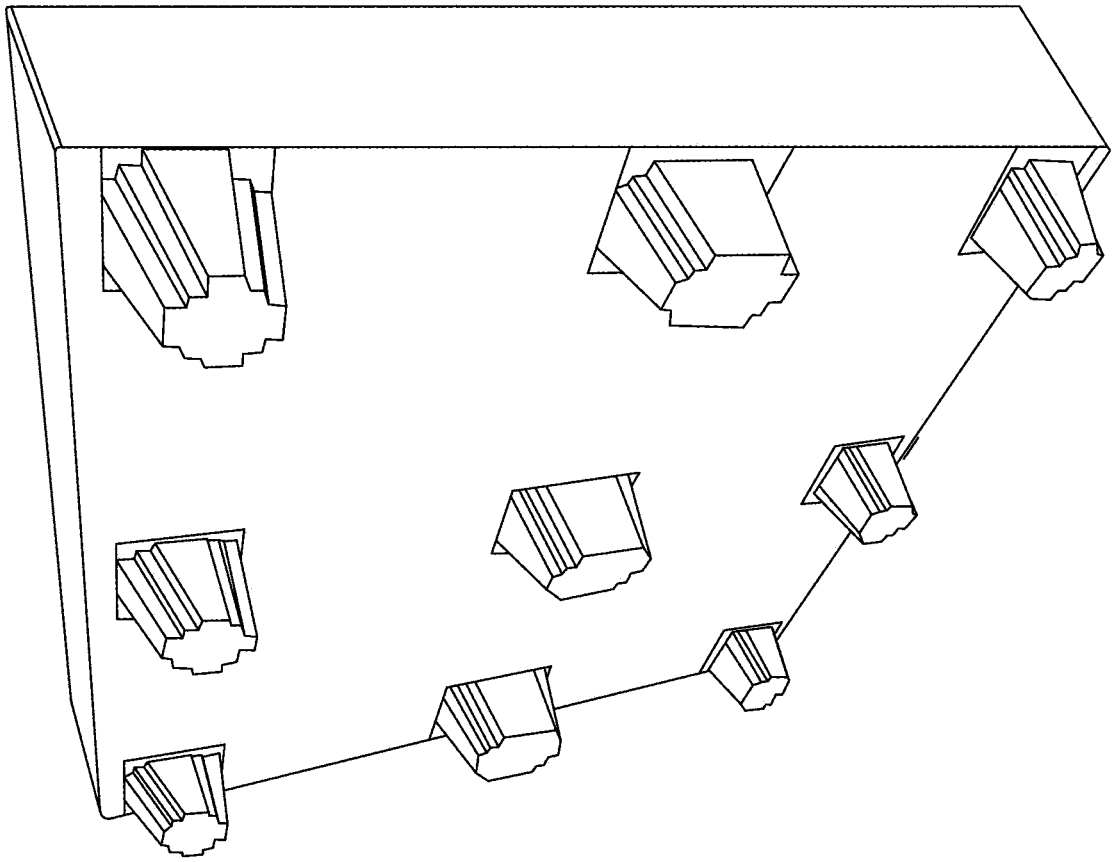
FIG. 8 shows the bottom side of an example configurable pallet with nine protrusions extending below the cardboard base.
Figure 9:
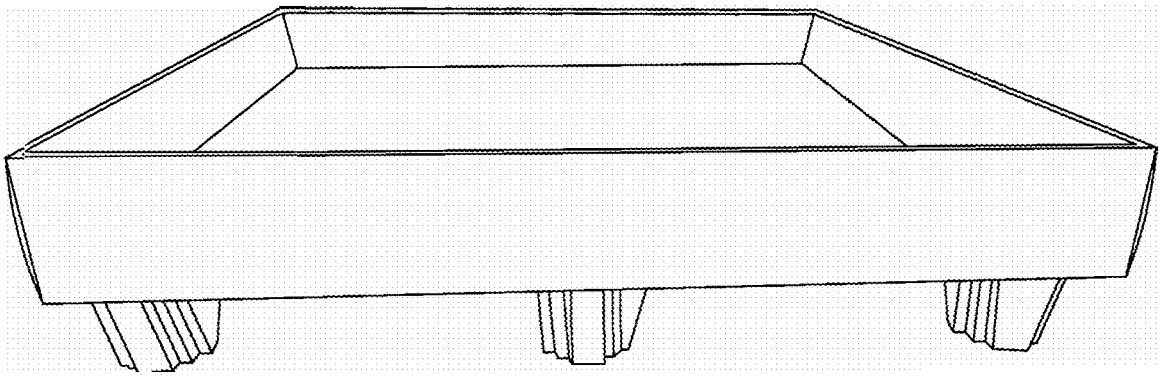
FIG. 9 is a side view of the example configurable pallet that shows three of the nine protrusions residing on the ground and extending below the bottom of the cardboard base.

FIG. 7 is a flow chart 700 illustrating a method for making the example configurable pallet described herein. At 710, a user may define or receive a dimension defining a distance between two pieces of the plastic base 110 and/or a dimension between protrusions of a plastic base. The dimension(s) may be as desired, or may be client or goods specific.

At 720, a plastic base may be provided, or produced or requested on demand, such as by three-dimensional printing on demand. The plastic base has two or more protrusions. In some embodiments, the plastic base may be of a standardized shape or dimensions. For standardized plastic bases, stored or in-stock, may be requested and provided.

At 730, a cardboard base is provided or made, for example, by a computer numerically controlled cutting machine. The cardboard base may include multiple openings for receiving the protrusions of the plastic bases, and to meet and align with the dimension(s) of the plastic base 110. The cardboard base may include foldable edges to provide side walls as described herein.

At 740, two or more protrusions of two or more pieces of the plastic bases are inserted into the multiple openings of the cardboard base. The number and spacing among the openings may be configured depending on specific packaging sizes or as desired.

At 750, adhesives (or couplings) may be applied or used in between the plastic base and the cardboard bases, such as between a bridge of the plastic base and a cardboard base. For example, the adhesives may be used to improve structural integrity between the plastic bases. In other embodiments, a cardboard top is provided. In such a case, adhesive may be provided between the cardboard top and/or the plastic bases and/or the cardboard base.

At 760, peripheral walls extending from the cardboard base may be folded and formed in certain embodiments. In some other embodiments, the walls are folded to overlap at least a portion of side walls of the plastic bases.

At 770, and in some embodiments, a cardboard top is provided or produced as a load distribution member. The cardboard top may be optional for some circumstances. In other embodiments, the load distribution member may be excess flaps or materials of the cardboard base folded onto the top of the plastic bases, which have their protrusions positioned in the openings at the cardboard base.

At 780, the cardboard top (or strips or edges) may be placed or positioned over the top of the plastic bases and/or the cardboard base. As such, the overall stiffness and integrity is enhanced. In certain embodiments, the cardboard top may be adhered to the plastic bases and/or the cardboard base. For example, the bending stiffness can be substantially increased after the cardboard top, the plastic bases, and the cardboard base are assembled. Before assembly, however, the individual pieces may be stored and transported occupying little space compared to conventional pallets. In some instances, the stacked components of the configurable pallets occupy $1/33^{rd}$ the space of conventional pallets.

At 790, sleeves that fully surround the loaded goods and a top covering lid may be added to complete the packaging of the goods or products stored on the configurable pallet. The full coverage enables more reliable protection of the loaded goods and can stand against certain outdoor elements, such as wind, dust, and moisture. Although the cardboard base, the cardboard top, the sleeves, and the lid are described using cardboard material, someone having ordinary skill in the art would understand the cardboard material may be replaced using another material, or modified by lamination or paint to improve structural or water-resistant properties.

The sleeve may be one large piece, multiple stacked sleeves, or may be pieces to form a sleeve. In one embodiment, there may be two "L" shaped pieces to form a sleeve that can be easily handled by one person without the need for a ladder, in one embodiment.

In some embodiments, the method for making a configurable pallet includes receiving a plastic base having two or more protrusions; the two or more protrusions spaced apart by a first dimension and connected by a bridge piece. A second dimension defining a distance between two pieces of the plastic base is received. A cardboard base having a plurality of openings is produced using the first dimension and the second dimension. Each of the multiple openings fitting one of the two or more protrusions. The two or more protrusions of two or more pieces of the plastic base may be inserted into the multiple openings to form the configurable pallet.

Although the preceding description has been described herein with reference to particular means, materials and embodiments, it is not intended to be limited to the particulars disclosed herein; rather, it extends to all functionally equivalent structures, methods, and uses, such as are within the scope of the appended claims.

What is claimed is:

1. A load-bearing platform for supporting goods, the load-bearing platform comprising:

two or more plastic bases, each having two or more protrusions connected by one or more bridge pieces, the two or more protrusions spaced apart a distance;

a cardboard base having openings spaced apart an amount and at least one peripheral wall configured to be positioned in a vertical position wherein the openings are configured to receive the two or more protrusions of the two or more plastic bases; and a load distribution member configured to contact at least a portion of the two or more plastic bases, wherein the load distribution member supports at least a portion of the goods and distributes at least a portion of a weight of the goods to at least a portion of the two or more plastic bases.

2. The load-bearing platform of claim 1, further comprising a cardboard top that serves as at least a portion of the load distribution member and connects at least a portion of the bridge piece with the cardboard base, the cardboard top supporting at least a portion of the goods placed thereon.

3. The load-bearing platform of claim 1, wherein the cardboard base includes four peripheral walls.

4. The load-bearing platform of claim 1, wherein the cardboard base may be positioned in a flat horizontal position, and the at least one peripheral wall is folded from the flat horizontal position to the vertical position.

5. The load-bearing platform of claim 4, wherein the at least one folded peripheral wall is adjacent the plastic base when the plastic base is fully inserted into the cardboard base.

6. The load-bearing platform of claim 4, wherein the cardboard base includes a first set of cut lines for removing pieces to create the openings and a second set of cut lines or indentations for folding up the at least one peripheral wall.

7. The load-bearing platform of claim 1, wherein the plastic base includes a side wall extending substantially orthogonally upward from a side edge of the bridge piece, wherein the side wall is enclosed into the at least one folded peripheral wall of the cardboard base.

8. The load-bearing platform of claim 1, wherein at least a portion of the bridge piece of the plastic base is affixed onto the cardboard base using an adhesive.

9. The load-bearing platform of claim 1, wherein each of the two or more plastic bases are shaped such that the protrusions of each plastic base can stack within another plastic base.

10. The load-bearing platform of claim 1, wherein each of the two or more plastic bases includes three protrusions and two bridge pieces.

11. The load-bearing platform of claim 10, further comprising one additional plastic base, wherein each of the at least three plastic bases includes three protrusions so as to provide at least nine protrusions in total, wherein the cardboard base includes at least nine openings configured to receive the nine protrusions.

12. The load-bearing platform of claim 1, further comprising a plurality of plastic bases with two or more protrusions, wherein the protrusions are legs for providing a space between the cardboard base and a ground surface to support the load-bearing platform, the space allowing a forklift to insert a fork underneath the cardboard base.

13. The load-bearing platform of claim 12, wherein a plurality of the protrusions includes a textured surface in contact with the ground surface.

14. The load-bearing platform of claim 11, wherein the plastic bases are configured to be stacked together by inserting the protrusions of one of the plastic bases into back sides of the corresponding protrusions of another of the plastic bases.

15. A method for making a configurable pallet for supporting goods, the method comprising:

providing a first plastic base with a first dimension distance between at least two protrusions, the first plastic base having two or more protrusions spaced apart by the first dimension and connected at least by a first bridge piece;

providing a second plastic base with a second dimension distance between at least two protrusions, the second plastic base having two or more protrusions spaced apart by the second dimension and connected at least by a second bridge piece;

providing a cardboard base having a plurality of openings corresponding to the two or more protrusions of the first and second plastic bases spaced apart by the first and second dimensions and at least one peripheral wall configured to be positioned in a vertical position; and inserting the two or more protrusions of the first and second plastic bases into the plurality of openings of the cardboard base to form the configurable pallet.

16. The method of claim 15, further comprising:

providing a cardboard top sized to cover at least a portion of the cardboard base and at least a portion of the bridge piece to support at least a portion of the goods.

17. The method of claim 16, further comprising connecting at least a portion of a bottom surface of the bridge piece of the first or second plastic base to the cardboard base.

18. The method of claim 16, wherein providing the cardboard base further comprises receiving a length dimension and a width dimension defining a surface area of the cardboard base to produce the cardboard base.

19. The method of claim 15, wherein providing a first and second plastic bases includes producing a plurality of plastic bases, wherein providing a cardboard base includes producing a plurality of openings corresponding to the two or more protrusions of the plurality of produced plastic bases, and wherein inserting the two or more protrusions of the plastic base includes the two or more protrusions of the plurality of plastic bases into the plurality of openings of the cardboard.

20. The method of claim 15, wherein providing the cardboard base further comprises producing the cardboard base by stamping, laser cutting, or machining the cardboard base to form the plurality of openings.

21. The method of claim 15, wherein providing the cardboard base further comprises producing the cardboard base by producing a side tab foldable into the peripheral wall that is adjacent the first or second plastic base when the protrusions of the first or second plastic bases are positioned into the cardboard base.

22. The method of claim 21, wherein providing the first or second plastic base with the first or second dimension further comprises providing the first or second plastic base with a side wall extending substantially orthogonally upward from a side edge of the bridge piece, wherein the side wall is enclosed into the folded peripheral wall of the cardboard base.

23. A configurable pallet configured to support goods, the configurable pallet comprising:

a cardboard base having an array of openings, the array having an opening spacing dimension and a coverage area specified by a user and at least one peripheral wall configured to be positioned in a vertical position;

two or more plastic bases, each of the two or more plastic bases having two or more protrusions connected by a bridge piece and spaced apart by the opening spacing dimension, the two or more protrusions inserted into the array of openings; and a cardboard member positioned at least partially over one or more bridge pieces of the two or more plastic bases and a part of the cardboard base, the cardboard member supporting at least a portion of the goods placed thereon.

24. The configurable pallet of claim 23, further comprising:

a sleeve configured to be supported by at least a portion of one or more of the plastic bases and at least a portion of the cardboard base, and to at least partially surround the goods placed on the configurable pallet.

25. The configurable pallet of claim 24, further comprising:

a cardboard lid configured to fit over a top opening in the sleeve.

26. The configurable pallet of claim 24, wherein the sleeve is provided as two pieces of angled cardboard.

27. The configurable pallet of claim 24, wherein the sleeve is provided as two sleeves, with one sleeve positioned at least partially above the other sleeve.

28. The configurable pallet of claim 24, wherein the sleeve is provided as a first piece and a second piece, each at least partially covering a portion of the goods, and wherein at least one edge of the first piece and the second piece are positioned adjacent one another to form the sleeve and to at least partially surround the goods placed on the configurable pallet.

29. A method for making a configurable pallet, the method comprising:

receiving two or more plastic bases having two or more protrusions; the two or more protrusions spaced apart by a first dimension and connected by a bridge piece;

receiving a second dimension defining a distance between two pieces of the plastic bases;

producing a cardboard base having a plurality of openings using the first dimension and the second dimension and at least one peripheral wall configured to be positioned in a vertical position, wherein a plurality of the openings are configured to surround one or more of the two or more protrusions of the two or more plastic bases; and inserting the two or more protrusions of two or more pieces of the plastic bases into the plurality of openings to form the configurable pallet.

* * * * *